US011904436B2

(12) United States Patent
Liu et al.

(10) Patent No.: US 11,904,436 B2
(45) Date of Patent: Feb. 20, 2024

(54) ABRASIVE WATER JET FULL-SECTION CUTTING TYPE CUTTER HEAD AND APPLICATION DEVICES

(71) Applicant: SHANDONG UNIVERSITY, Shandong (CN)

(72) Inventors: Dun Liu, Shandong (CN); Yifei Zhang, Shandong (CN); Hongtao Zhu, Shandong (CN); Weijie Zhang, Shandong (CN); Chuanzhen Huang, Shandong (CN)

(73) Assignee: SHANDONG UNIVERSITY, Shandong (CN)

( * ) Notice: Subject to any disclaimer, the term of this patent is extended or adjusted under 35 U.S.C. 154(b) by 11 days.

(21) Appl. No.: 17/367,415

(22) Filed: Jul. 4, 2021

(65) Prior Publication Data

US 2022/0314400 A1 Oct. 6, 2022

(30) Foreign Application Priority Data

Apr. 2, 2021 (CN) ..... 202110362877.5
May 17, 2021 (CN) ..... 202110534073.9

(51) Int. Cl.
*B24C 1/04* (2006.01)
*B24C 7/00* (2006.01)

(52) U.S. Cl.
CPC ..... *B24C 1/045* (2013.01); *B24C 7/0007* (2013.01)

(58) Field of Classification Search
CPC ..... E21B 10/60; E21B 10/602; E21B 10/605; E21B 10/61; E21B 10/08; E21B 21/065; E21B 7/16; E21B 7/18; E21B 7/24; B24C 1/04; B24C 1/045; B24C 5/02; B24C 5/04; B24C 3/16; B24C 3/32; B24C 3/325; B24C 7/0007; B24C 7/0038; B24C 7/0076; B24C 3/327; B24B 5/06; B24B 5/08; B24B 5/10; B24B 5/40; B24B 33/027; F16L 55/38; F28G 3/14; F28G 3/16; F28G 3/163
See application file for complete search history.

(56) References Cited

U.S. PATENT DOCUMENTS 3,414,070 A * 12/1968 Pekarek ..... E21B 10/60 175/393
2005/0034901 A1* 2/2005 Meyer ..... E21B 10/60 175/393
2007/0163811 A1* 7/2007 Gutmark ..... E21B 10/61 175/393
2017/0008150 A1* 1/2017 Linde ..... B05B 3/025
2020/0347679 A1* 11/2020 Lacroix ..... E21B 7/18

* cited by examiner

*Primary Examiner* — Laura C Guidotti
*Assistant Examiner* — Sidney D Full
(74) *Attorney, Agent, or Firm* — JCIP GLOBAL INC.

(57) ABSTRACT

The present disclosure discloses an abrasive water jet full-section cutting type cutter head and application devices. The cutter head includes a cutter head body and a rotor eccentrically arranged on a working surface of the cutter head body. The rotor revolves with the cutter head body and also rotates about its own axis. At least one first nozzle is arranged on an edge of a working surface of the rotor. At least one group of second nozzles and at least one third nozzle are arranged on the working surface of the cutter head body, and the second nozzles and the third nozzle cooperate during the rotation of the cutter head body and the rotor, then a material to be cut is cut into a plurality of concentric rings, and the first nozzle cuts off the ring material to form fragments.

9 Claims, 5 Drawing Sheets

ABRASIVE WATER JET FULL-SECTION CUTTING TYPE CUTTER HEAD AND APPLICATION DEVICES

CROSS-REFERENCE TO RELATED APPLICATION

This application claims the priority benefits of China application serial no. 202110362877.5, filed on Apr. 2, 2021 and China application serial no. 202110534073.9, filed on May 17, 2021. The entirety of the above-mentioned patent application is hereby incorporated by reference herein and made a part of this specification.

FIELD OF THE INVENTION

The present disclosure discloses an abrasive water jet full-section cutting type cutter head and application devices, belonging to the field of tunneling or building demolition.

BACKGROUND OF THE INVENTION

The statement herein only provides background art related to the present disclosure, and does not necessarily constitute the prior art.

The inventor found, in the fields of hard rock tunneling or building demolition, mechanical methods are commonly used at present to implement tunneling or demolition. Their principle is to squeeze and chop materials with disc hobs. Therefore, tools are prone to wear during the process of tunneling, and frequent tool changes are required, resulting in high cost and low efficiency. In addition, the mechanical rock breaking and demolition methods also have disadvantages, such as excessive bearing load, more dust, and higher operating temperature. A water jet-assisted mechanical rock breaking and demolition method expands micro-cracks on rock or buildings with the help of high-pressure water wedge action based on the mechanical rock breaking and demolition methods, thereby reducing the stress of a cutter head, lowering the working temperature and eliminating dust, but because its core working principle is the same as that of the mechanical rock breaking and demolition methods, the problems of large tool wear, high bearing load and the like also cannot be completely solved.

SUMMARY OF THE INVENTION

In view of the shortcomings of the prior art, the objective of the present disclosure is to provide an abrasive water jet full-section cutting type cutter head application devices, which can implement hard rock tunneling or building demolition. Different from various mechanical rock breaking and demolition methods, the core of the present disclosure is to implement full-section cutting only by abrasive water jet.

In order to achieve the above objective, the present disclosure is achieved by the following technical solutions:

An embodiment of the present disclosure provides an abrasive water jet full-section cutting type cutter head, comprising a cutter head body and a rotor eccentrically arranged on a working surface of the cutter head body, the cutter head body rotates under the driving of a driving device; the rotor revolves with the cutter head body and also rotates about its own axis, and a first nozzle is arranged on an edge of a working surface of the rotor; at least one group of second nozzles and a third nozzle are arranged on the working surface of the cutter head body, and the second nozzles and the third nozzle cooperate during the rotation of the cutter head body and the rotor, so that jet flows are combined into net-like trajectories that completely cover a region to be cut in front of the cutter head body, then a material to be cut in front of the cutter head body is cut into a plurality of concentric rings during motion, and the first nozzle cuts off the ring material with the motion of the cutter head body and the rotor to form fragments.

As a further technical solution, jet lines of the first nozzle and the third nozzle are parallel to the axis of the cutter head body, or the jet lines of the first nozzle and the third nozzle and the axis of the cutter head are at set angles. The specific angles only need to meet the jet purposes of the first nozzle and the third nozzle.

As a further technical solution, each group of second nozzles includes two second nozzles, and the angle between the jet lines of two second nozzles in the same group is greater than 0° and less than 180°. The angles between the jet lines of the second nozzles of different groups are identical or different.

As a further technical solution, the distances between the second nozzles of adjacent groups are identical or different.

As a further technical solution, the jet lines of two second nozzles in the same group intersect or do not intersect.

As a further technical solution, the angle between the jet line of the second nozzle and/or the third nozzle and the working surface of the cutter head body is adjustable; and the angle between the jet line of the first nozzle and the axis of the rotor is adjustable.

In the second aspect, the present disclosure further provides a demolition device, comprising the aforementioned abrasive water jet full-section cutting type cutter head.

In the third aspect, the present disclosure further provides a tunneling device, comprising the aforementioned abrasive water jet full-section cutting type cutter head.

The beneficial effects of the above embodiments of the present disclosure are as follows:

In the present disclosure, the second nozzles in pair and the single third nozzle on the cutter head body cooperate, so that jet flows are combined into net-like trajectories that completely cover a region to be cut in front of the cutter head body, then a material to be cut in front of the cutter head body is cut into a plurality of concentric rings during motion. The main difference between the single third nozzle and the second nozzles in pair lies in that the third nozzle is used to cut edge material.

The main function of the first nozzle on the rotor is to cut the ring material with the motion of the cutter head body and the rotor to facilitate the removal of the material in blocks.

The present disclosure fully exerts the characteristics of strong processing capability, great processing depth and small processing area of abrasive water jet, cuts materials into fragments of a predetermined size with a few nozzles by using a full-section cutting type processing method, and therefore has the advantages of high efficiency, low energy loss, no tool wear, low bearing load, good material adaptability, low pump load, less dust and little processing heat.

BRIEF DESCRIPTION OF THE DRAWINGS

The accompanying drawings constituting a part of the present disclosure are used for providing a further understanding of the present disclosure, and the schematic embodiments of the present disclosure and the descriptions thereof are used for interpreting the present disclosure, rather than constituting improper limitations to the present disclosure.

DETAILED DESCRIPTION OF THE EMBODIMENTS

It should be pointed out that the following detailed descriptions are all exemplary and aim to further illustrate the present disclosure. Unless otherwise specified, all technological and scientific terms used in the present disclosure have the same meanings generally understood by those of ordinary skill in the art of the present disclosure.

It should be noted that the terms used herein are merely for describing specific embodiments, but are not intended to limit exemplary embodiments according to the present disclosure. As used herein, unless otherwise clearly stated in the present disclosure, the singular form is also intended to include the plural form. In addition, it should also be understood that when the terms "include" and/or "comprise" are used in the Description, they indicate features, steps, operations, devices, components, and/or combinations thereof.

As introduced in the background art, in the fields of hard rock tunneling or building demolition, mechanical methods are commonly used at present to implement tunneling or demolition. Their principle is to squeeze and chop materials with disc hobs. Therefore, tools are prone to wear during the process of tunneling, and frequent tool changes are required, resulting in high cost and low efficiency. In addition, the mechanical rock breaking and demolition methods also have disadvantages, such as excessive bearing load, more dust, and higher operating temperature. A water jet-assisted mechanical rock breaking and demolition method expands micro-cracks on rock or buildings with the help of high-pressure water wedge action based on the mechanical rock breaking and demolition methods, thereby reducing the stress of a cutter head, lowering the working temperature and eliminating dust, but because its core working principle is the same as that of the mechanical rock breaking and demolition methods, the problems of large tool wear, high bearing load and the like also cannot be completely solved.

In order to solve the above technical problems, the present disclosure proposes an abrasive water jet full-section cutting type demolition and tunneling device. This device fully exerts the characteristics of strong processing capability, great processing depth and small processing area of abrasive water jet, cuts materials into fragments of a predetermined size with a few nozzles by using a full-section cutting type processing method, and therefore has the advantages of high efficiency, low energy loss, no tool wear, low bearing load, good material adaptability, low pump load, less dust and little processing heat.

Figure 1:
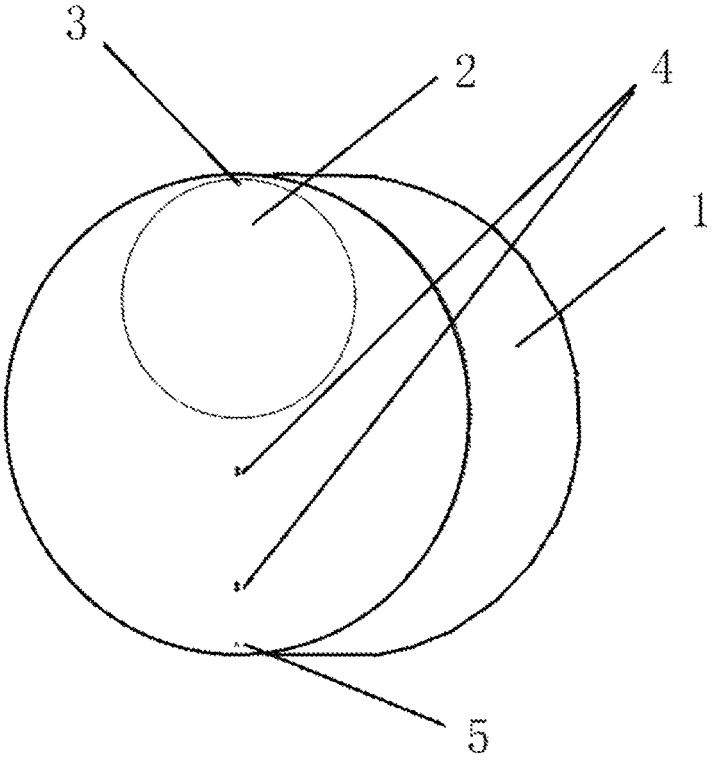
FIG. 1 is a schematic diagram of an abrasive water jet cutter head body and a rotor according to Embodiment 1 of the present disclosure.
Figure 2:
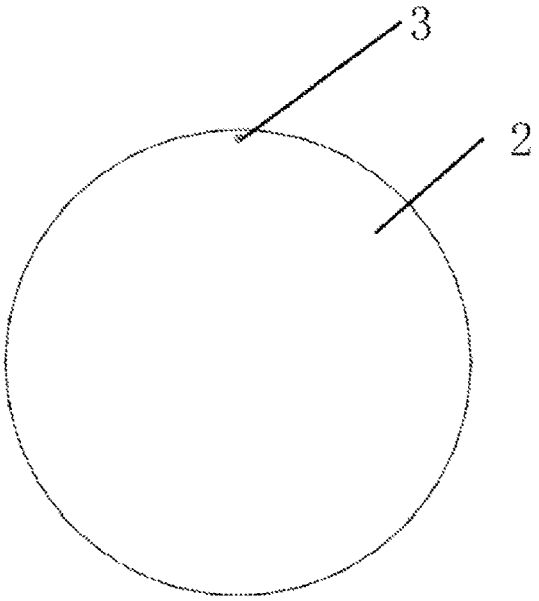
FIG. 2 is a schematic diagram of a disc rotor in Embodiment 1 of the present disclosure.
Figure 3:
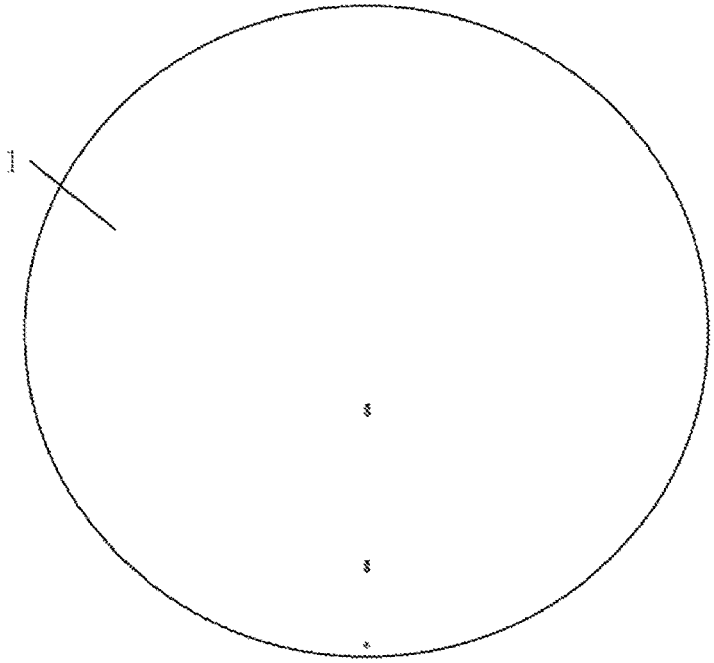
FIG. 3 is a schematic diagram of arrangement of second nozzles and a third nozzle on the cutter head body in Embodiment 1 of the present disclosure.
Figure 4:
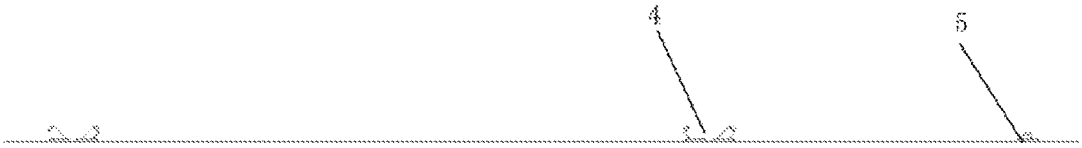
FIG. 4 is a schematic diagram of arrangement of second nozzles and a third nozzle on the cutter head body in Embodiment 1.

In a typical embodiment of the present disclosure, as shown in FIG. 1, an abrasive water jet full-section cutting type cutter head proposed by the present disclosure has the core innovation of realizing cutting of a region to be processed only by abrasive water jet. The cutter head includes a cutter head body 1, a rotor 2 and a plurality of abrasive water nozzles. The cutter head body 1 is of a rotatable disc structure, and its specific shape can be designed according to actual application scenarios, for example, in the field of tunneling, the cutter head body 1 can be designed with reference to a cutter head body in front of an existing shield tunneling machine; and in the field of demolition, the cutter head body 1 can be designed with reference to a cutter head body in front of an existing demolition machine, so details are not described herein again. This embodiment differs from the prior art in that a disc rotor 2 (as shown in FIG. 2) that can rotate with the cutter head body 1 and can also rotate autonomously is eccentrically arranged on a working surface of the cutter head body 1, and any existing hob and the like are not used. It should be noted that the working surface of the cutter head body 1 defined herein refers to a surface of the cutter head body facing the region to be processed during processing. Optimally, the rotor 2 is arranged close to an edge of the cutter head body 1. Further, in order to implement cutting, there is at least one first nozzle 3 on an edge of the rotor 2, and the working surface of the cutter head body 1 is further provided with at least one group of second nozzles 4 that are arranged according to the predetermined rule and have certain inclination angles and at least one third nozzle 5 (as shown in FIG. 3), that is, the number of nozzles on the cutter head body is an odd number. It should be noted that, preferably, the second nozzles 4 and the third nozzle 5 are arranged in a region of the working surface of the cutter head body 1 that does not overlap the rotor 2.

Further, in order to further describe the positional relationship of the first nozzle 3, the second nozzles 4 and the third nozzle 5 clearly in this embodiment, an inner side and an outer side are defined in this embodiment. In the radial direction of the working surface of the cutter head body 1, the inner side is defined close to the axis of the cutter head body, and the outer side is defined away from the axis of the cutter head body. According to this orientation, the third nozzle 5 is on the outer side of the working surface of the cutter head body, the plurality of groups of second nozzles 4 are on the inner side of the working surface of the cutter head body, and the third nozzle 5 is on the edge of the working surface of the cutter head body 1. The first nozzle 3 on the rotor is located in the third nozzle 5 in the radial direction, that is, the motion trajectory of the first nozzle 3 is located in a circle formed by the third nozzle 5.

Figure 8:
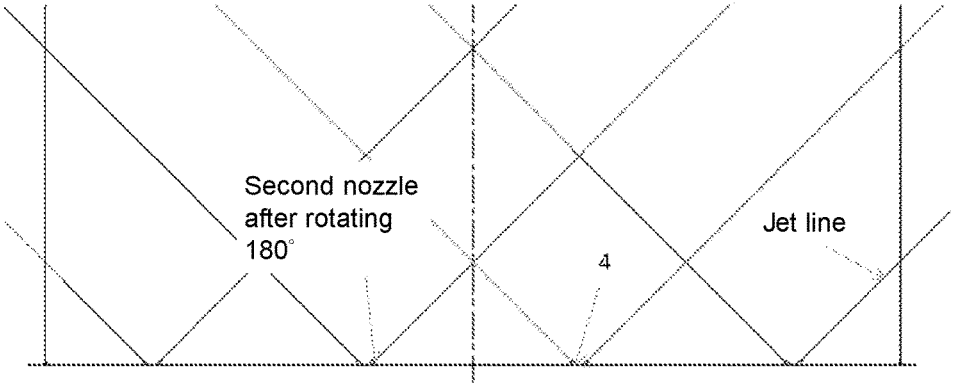
FIG. 8 is a schematic diagram of the cutter head body of the device in a jet state in Embodiment 1.
Figure 9:
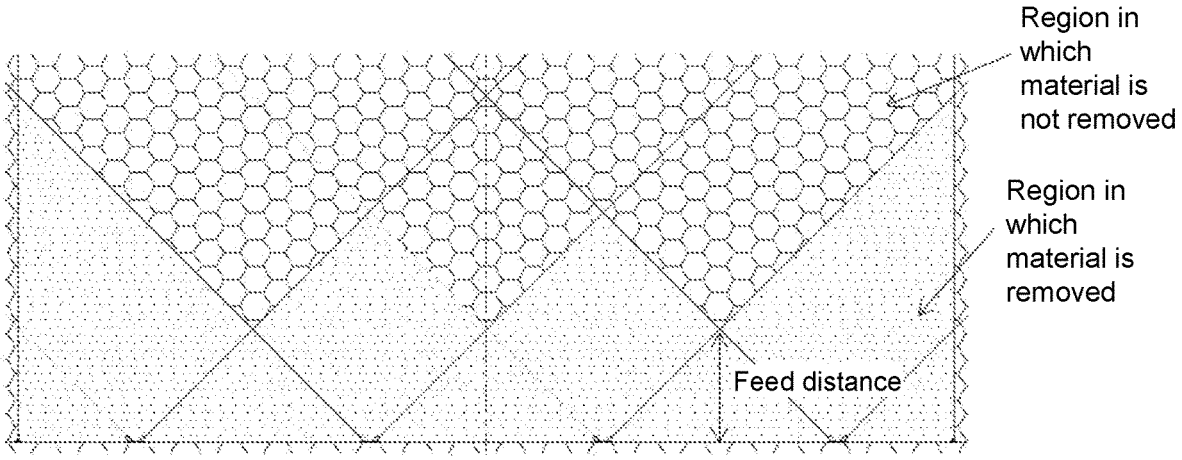
FIG. 9 is a schematic diagram illustrating that the cutter head body of the device in the jet state cuts a material in Embodiment 1.
Figure 10:
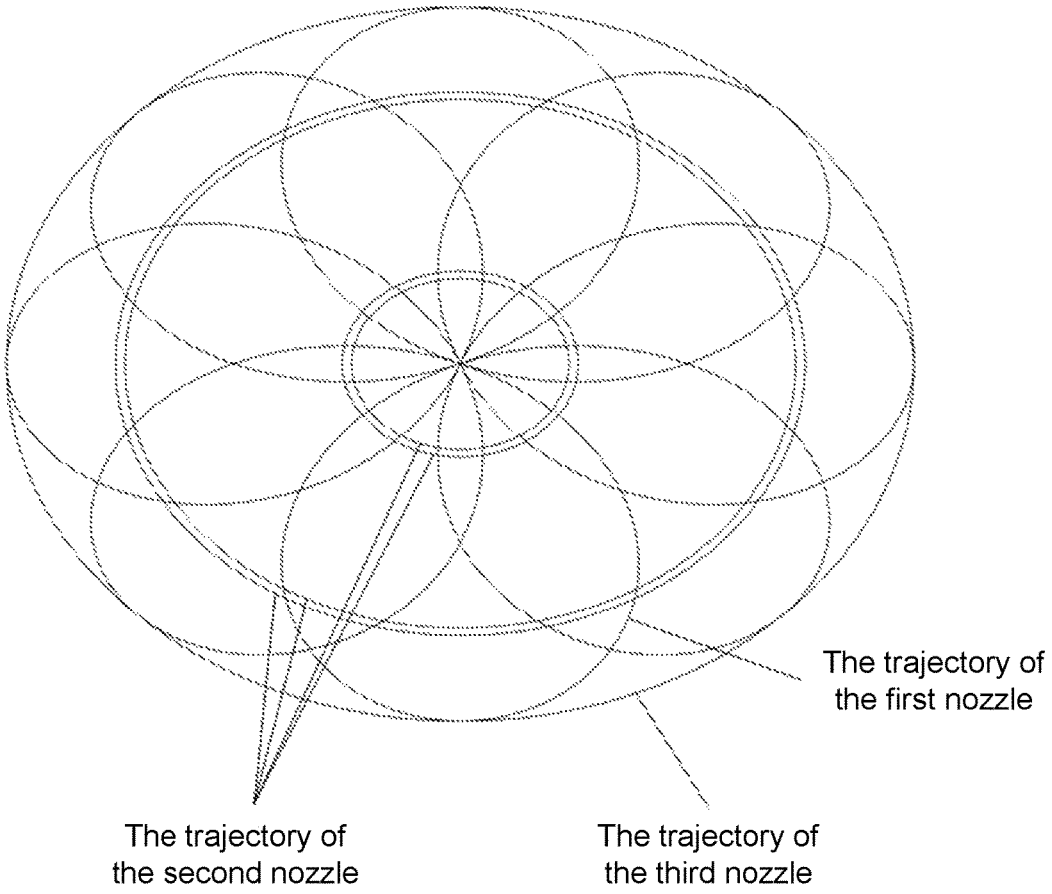
FIG. 10 is a schematic diagram of motion trajectories of the first nozzle, the second nozzles and the third nozzle in Embodiment 1.

The plurality of groups of second nozzles 4 and the third nozzle 5 on the cutter head body cooperate, so that jet flows are combined into net-like trajectories that completely cover the region to be cut in front of the cutter head body 1 (see FIG. 8 for details), and then the material to be cut in front of the cutter head body is cut into a ring shape during motion. FIG. 8 shows a shape diagram of a cross section perpendicular to the working surface of the cutter head body (a schematic diagram of nozzles and jet trajectories when the second nozzles 4 and the third nozzle 5 do not rotate and rotate 180°). Two groups of second nozzles 4 form net-like jet lines, which separates the material to be cut from surrounding materials and forms the plurality of concentric rings.

The third nozzle is used to cut off the material at the edge. The first nozzle on the rotor mainly functions to cut the ring material with the movement of the cutter head body and the rotor, to facilitate the removal of the material in blocks.

It should be further noted that the jet directions of the first nozzle 1 and the third nozzle 5 in this embodiment are the same, and both are parallel to the axis direction of the cutter head body; and the jet direction of the second nozzles 4 is required to be neither parallel nor perpendicular to the axis direction of the cutter head body. It should be noted that in other embodiments, the jet directions of the first nozzle 1 and the third nozzle 5 can also be at certain angles to the axis of the cutter head body, as long as the first nozzle 1 can achieve the purpose of cutting the ring structures formed by the second nozzles 4 to implement material cutting, and the third nozzle 5 separately arranged on the cutter head body can cut the material at the edge of the trajectory as required.

Figure 5:
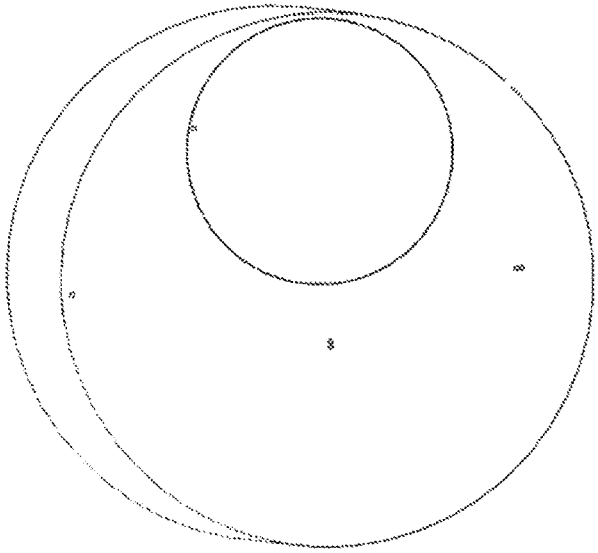
FIG. 5 is a schematic diagram of an abrasive water jet cutter head body and a rotor in another embodiment.

It should be further noted that the second nozzles 4 and the third nozzle 5 in this embodiment are located on a straight line where the diameter of the working surface of the cutter head body is located, and are located on the same straight line as the first nozzle 3 on the rotor; and the first nozzle 3 is also located on the straight line where the diameter of the rotor is located. Of course, it is understandable that in other embodiments, the second nozzles 4 and the third nozzle 5 can also be arranged on a line where the diameter of the cutter head body is not located, and similarly, the first nozzle 3 can also be arranged on a straight line where the diameter of the rotor is not located. It is further understandable that in other embodiments, the second nozzles 4, the third nozzle 5 and the first nozzle 3 may not be on a straight line, and their arrangement shown in FIG. 5 is allowable as long as the distances between the second nozzles 4 and third nozzle 5 and the rotation center of the cutter head body are set as required, and the positions of the second nozzles 4 and the third nozzle 5 in the circumferential direction of the cutter head body are not limited. Similarly, the distance between the first nozzle 3 and the center of the rotor is set as required, and the position of the first nozzle 3 in the circumferential direction of the rotor is not limited.

Further in this embodiment, two groups of second nozzles 4 are included, each group includes two nozzles, and the angle between the jet lines of two nozzles in the same group theoretically only needs to be greater than 0° and less than 180°; however, the actual selection of the angle needs to weigh the effects of the processing capability of the nozzles, the single feed distance, and the distance between adjacent nozzles on the angle selection; generally, when the processing capability of the nozzles is weak, two second nozzles in the same group can be arranged at an obtuse angle, and the larger the angle, the shorter the jet processing length required when the jet flows of the adjacent nozzles intersect, the more it can alleviate the deficiency caused by the weak processing capability of the nozzles; when the single feed distance is large, two second nozzles in the same group can be arranged at an acute angle, because the larger the distance between the jet flow intersection of the adjacent nozzles and the working surface of the cutter head body, the larger the single feed distance; and when the distance between the second nozzles in the adjacent groups is large, two second nozzles in the same group can be arranged at an obtuse angle, and the larger the angle, the smaller the jet processing length required when the jet flows of the adjacent nozzles intersect, so as to offset the problem that the jet flows are difficult to intersect due to the large distance between the adjacent nozzles. In addition, the jet lines of the nozzles in the same group can intersect.

Furthermore, it should be noted that the set group number, spacing and angle of the second nozzles 4 can be adjusted according to the cutting capacity of the abrasive water jet on specific materials; the specific number of nozzles should be set according to the spacing and the diameter of the shield tunneling machine, the nozzle spacing and angle settings relates to the processing capability of the nozzles and the single feed distance, and if the nozzle spacing needs to be reduced and the single feed distance needs to be kept unchanged, the angles of the nozzles need to be increased. A specific example is shown in FIG. 5. Because the outer nozzle has a larger linear velocity than the inner nozzle, its processing capability is weaker. In order to balance the processing capabilities of the inner and outer nozzles, the spacing between the outer nozzles is reduced, and the spacing between the inner nozzles is increased. In order to compensate for the reduction of the single feed distance caused by the reduction of the nozzle spacing, the angle of the nozzle that is far from the center of rotation is appropriately increased.

Figure 6:
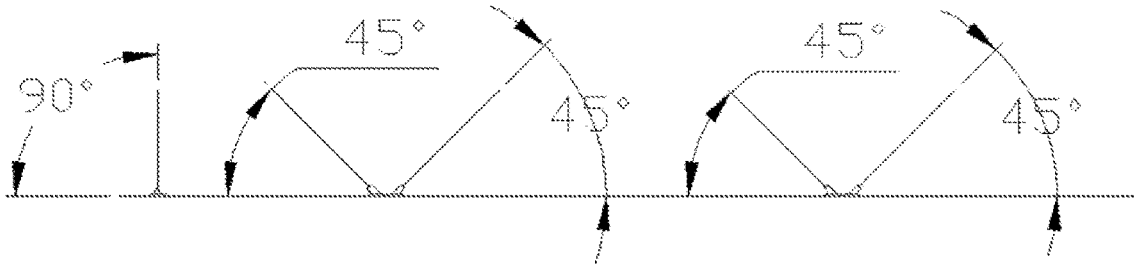
FIG. 6 is a schematic diagram of angle settings of second nozzles and a third nozzle in the abrasive water jet cutter head body in another embodiment.
Figure 7:
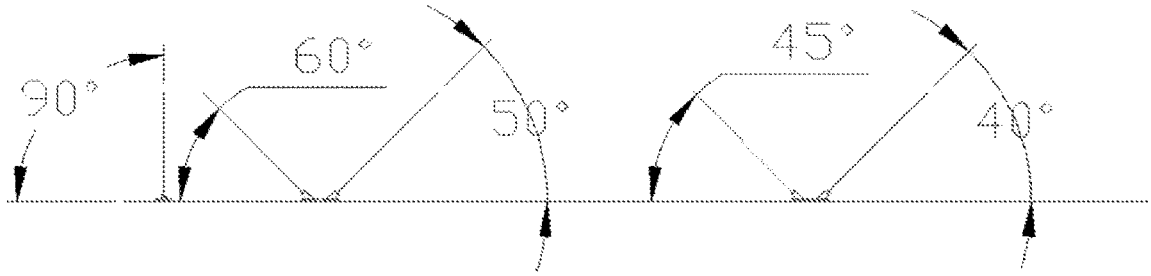
FIG. 7 is a schematic diagram of angle settings of second nozzles and a third nozzle in the abrasive water jet cutter head body in another embodiment.

It should be further noted that the angles of the second nozzles 4 in different groups may be completely identical, not completely identical or completely different. For example, as shown in FIG. 6 and FIG. 7, two groups of second nozzles 4 are at the same angle of 90° in FIG. 6; in FIG. 7, two groups of second nozzles 4 are at different angles, the angle between the second nozzles of the left group is 70°, and the angle between the second nozzles of the right group is 85°; and when the second nozzles are arranged in three groups or more, the angles of the second nozzles 4 in the a plurality of groups may be completely identical, not completely identical or completely different.

It should be further noted that the second nozzles 4 and/or the third nozzle 5 are connected to the cutter head body in a swing or fixed manner, and the first nozzle 3 is connected to the rotor in a swing or fixed manner; when first nozzle 3 and the rotor are connected in the swing manner, the angles between the jet lines of the first nozzle 3, the second nozzles 4 and/or the third nozzle 5 and the working surface of the cutter head body are adjustable, or some nozzles of the first nozzle 3, the second nozzles 4 and the third nozzle 5 are configured in angle adjustable swing connection as required to meet different cutting requirements.

It should be further noted that the specific number of the first nozzles can be set according to actual engineering needs, the cut material is finally more broken if there are more first nozzles, and when the number of the first nozzles is plural, a plurality of first nozzles can be arranged at any positions on the rotor, as long as they can cut off the ring material.

It should be further noted that one or more third nozzles 5 can be provided in this embodiment; and when a plurality of third nozzles 5 are provided, the motion trajectories of the third nozzles 5 are generally required to be the same, which is the same circle.

Figure 11:
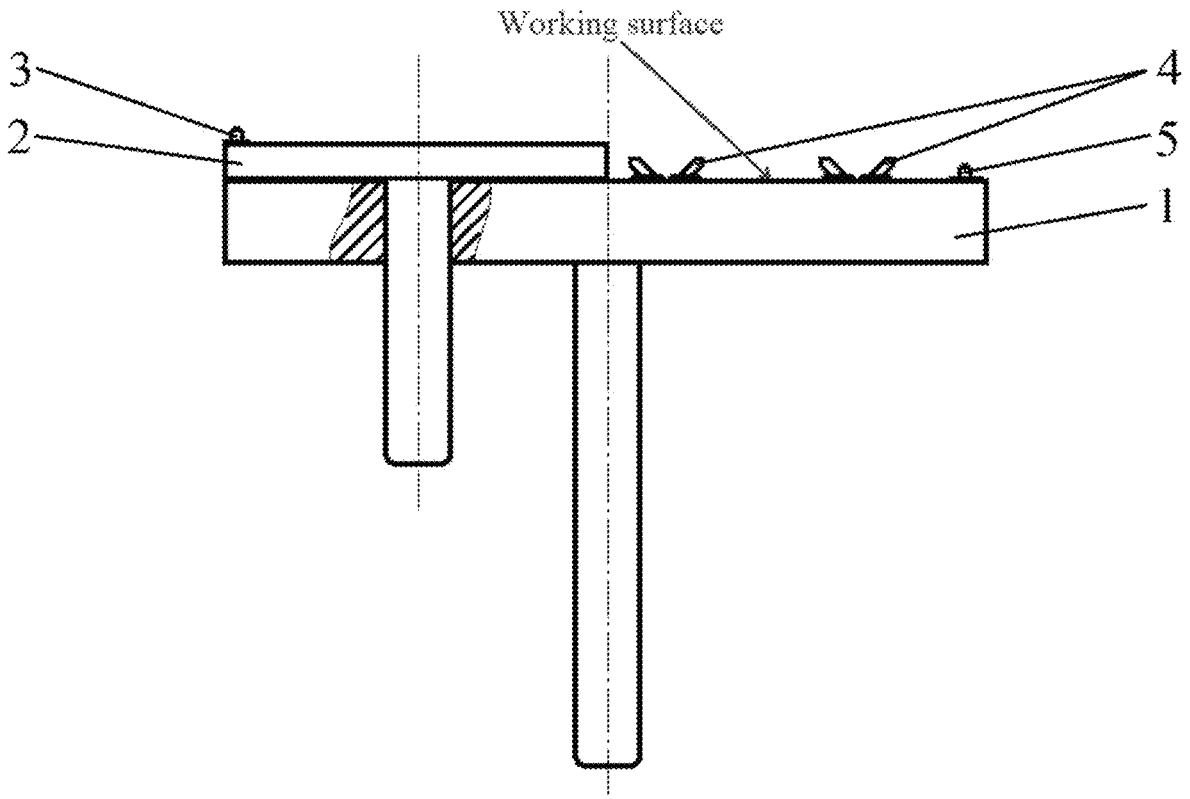
FIG. 11 is a side view of the cutter head.

Further, the motion of the rotor and the cutter head body in this embodiment is controlled as follows:

When the shield tunneling machine is operating, both the cutter head body and the rotor rotate, the cutter head body revolves, the rotor revolves and rotates at the same time, and the cutter head body and the rotor move together; as shown in FIG. 11, specifically, a motor, a reduction box and an electric control device can be installed individually at a main shaft of the cutter head body to control the revolution, and a motor, a reduction box and an electric control device can be installed individually at a main shaft of the rotor to control the rotation; or a motor, a reduction box and an electric control device are separately installed at the main shaft of the cutter head body to drive the revolution, and gears cooperate to limit the speed relationship between revolution and rotation and provide power for rotation. The two methods can change the speed relationship between revolution and rotation through the reduction box, which can be set according to the actual situation.

It should be further noted that the jet pressure of the nozzles in this embodiment should meet the requirements of material cutting.

It should be further noted that the cutter head disclosed in this example can be used in the field of hard rock tunneling to cooperate with an existing tunneling device, such as a main body of a shield tunneling machine, so as to complete corresponding tunneling; and the cutter head can also be used in the field of demolition of buildings to cooperate with an existing demolition device, such as a demolition main body, so as to complete corresponding demolition.

The technical features of the above-described embodiments may be combined arbitrarily. For the purpose of simplicity in description, all the possible combinations of the technical features in the above embodiments are not described. However, as long as the combinations of these technical features do not have contradictions, they shall fall within the scope of the specification.

Finally, it should further be noted that the relationship terms such as first and second are used only to differentiate one entity or operation from the other entity or operation, and do not require or imply any actual relationship or sequence between these entities or operations.

Described above are merely preferred embodiments of the present disclosure, and the present disclosure is not limited thereto. Various modifications and variations may be made to the present disclosure for those skilled in the art. Any modification, equivalent substitution or improvement made within the spirit and principle of the present disclosure shall fall into the protection scope of the present disclosure.

What is claimed is:

1. An abrasive water jet full-section cutting type cutter head, comprising a cutter head body and a rotor eccentrically arranged on a working surface of the cutter head body, wherein the cutter head body is rotatable; the rotor revolves with the cutter head body about an axis of the rotation of the cutter head body and also rotates on an axis of the rotor; at least one first nozzle is arranged close to an edge of a working surface of the rotor; at least two groups of second nozzles, wherein each group comprises at least one second nozzle, and at least one third nozzle are arranged on the working surface of the cutter head body, during the rotation of the cutter head body and the rotor, abrasive water jet flows of the second nozzles of the at least two groups and the at least one third nozzle cooperate to form a combined abrasive water jet flow producing cutting trajectories that cover a region to be processed in front of the cutter head body, then a material to be cut in front of the cutter head body is cut into a plurality of concentric rings during motion, and an abrasive water jet flow of the at least one first nozzle cuts the plurality of concentric rings into fragments with the motion of the cutter head body and the rotor.

2. The abrasive water jet full-section cutting type cutter head according to claim 1, wherein a plurality of lines of the abrasive water jet flows of the at least one first nozzle and the at least one third nozzle are parallel to the axis of the cutter head body, or the plurality of lines of the abrasive water jet flows of the at least one first nozzle and the at least one third nozzle and the axis of the cutter head body are at set angles.

3. The abrasive water jet full-section cutting type cutter head according to claim 1, wherein each group of the second nozzles comprises two second nozzles, and an angle between a plurality of lines of the abrasive water jet flows of the two second nozzles in the same group is greater than 0° and less than 180°.

4. The abrasive water jet full-section cutting type cutter head according to claim 3, wherein the angles between the plurality of lines of the abrasive water jet flows of the second nozzles in different groups are identical or different.

5. The abrasive water jet full-section cutting type cutter head according to claim 3, wherein distances between the second nozzles of adjacent groups are identical or different.

6. The abrasive water jet full-section cutting type cutter head according to claim 3, wherein the plurality of lines of the abrasive water jets of the two second nozzles in the same group intersect or do not intersect.

7. The abrasive water jet full-section cutting type cutter head according to claim 1, wherein an angle between a line of the abrasive water jet flow of the second nozzle in one of the at least two groups of second nozzles and/or the at least one third nozzle and the working surface of the cutter head body is adjustable.

8. The abrasive water jet full-section cutting type cutter head according to claim 7, wherein an included angle between a line of the abrasive water jet flow of the at least one first nozzle and the axis of the rotor is adjustable.

9. The abrasive water jet full-section cutting type cutter head according to claim 1, wherein an angle between a line of the abrasive water jet flow of the at least one first nozzle and the axis of the rotor is adjustable.

* * * * *